US011303071B2

(12) United States Patent
Xu et al.

(10) Patent No.: US 11,303,071 B2
(45) Date of Patent: Apr. 12, 2022

(54) CONNECTOR HAVING SPACER ENHANCING CONNECTIONS WITH CONTACTS AND MANUFACTURING METHOD THEREOF

(71) Applicant: DONGGUAN LEADER PRECISION INDUSTRY CO., LTD, Dongguan (CN)

(72) Inventors: Li-Jun Xu, Dongguan (CN); Hong-Qiang Xu, Dongguan (CN); Meng-Jie Peng, Dongguan (CN); Yong Wang, Dongguan (CN)

(73) Assignee: DONGGUAN LEADER PRECISION INDUSTRY CO., LTD, Guangdong (CN)

( * ) Notice: Subject to any disclaimer, the term of this patent is extended or adjusted under 35 U.S.C. 154(b) by 0 days.

(21) Appl. No.: 17/017,234

(22) Filed: Sep. 10, 2020

(65) Prior Publication Data

US 2020/0412065 A1 Dec. 31, 2020

(30) Foreign Application Priority Data

Dec. 9, 2019 (CN) ..... 201911250694.3

(51) Int. Cl.
*H01R 13/6585* (2011.01)
*H01R 24/60* (2011.01)
(Continued)

(52) U.S. Cl.
CPC ..... *H01R 13/6585* (2013.01); *H01R 13/405* (2013.01); *H01R 24/60* (2013.01); *H01R 43/02* (2013.01); *H01R 43/20* (2013.01)

(58) Field of Classification Search
None
See application file for complete search history.

(56) References Cited

U.S. PATENT DOCUMENTS 9,461,415 B2 * 10/2016 Guo ..... H01R 13/41
9,525,244 B1 * 12/2016 Hsu ..... H01R 13/6594
(Continued)

FOREIGN PATENT DOCUMENTS

CN 105703124 B 6/2018
CN 106848696 B 4/2019
(Continued)

*Primary Examiner* — Oscar C Jimenez
(74) *Attorney, Agent, or Firm* — Birch, Stewart, Kolasch & Birch, LLP

(57) ABSTRACT

A connector includes first contacts, second contacts, a middle plate, a first electromagnetic compatibility (EMC) pad, a second EMC pad, an insulating body, and a spacer. The middle plate is clamped between the first contacts and the second contacts. The first EMC pad is located above the first contacts. The second EMC pad is located below the second contacts. The first EMC pad and the second EMC pad are connected to the middle plate respectively. The insulating body is partially embedded with the first contacts, the second contacts, the middle plate, the first EMC pad, and the second EMC pad. The spacer is formed between the first contacts and the second contacts, and is partially embedded with the first contacts and the second contacts. A manufacturing method where the connector is assembled as a semi-finished product in advance is further provided to reduce the production cost.

16 Claims, 8 Drawing Sheets

(51) Int. Cl.

| | |
|---|---|
| ***H01R 43/02*** | (2006.01) |
| ***H01R 13/405*** | (2006.01) |
| ***H01R 43/20*** | (2006.01) |

(56) References Cited

U.S. PATENT DOCUMENTS

| | | | | |
|---|---|---|---|---|
| 9,653,850 | B1 * | 5/2017 | Su | H01R 24/60 |
| 9,768,545 | B1 * | 9/2017 | Hsu | H01R 13/521 |
| 10,103,499 | B2 * | 10/2018 | Tsai | H01R 13/6593 |
| 2015/0303629 | A1 * | 10/2015 | MacDougall | H01R 13/6581<br>439/607.01 |
| 2016/0049756 | A1 * | 2/2016 | Yen | H01R 13/6585<br>439/676 |
| 2016/0141806 | A1 * | 5/2016 | Guo | H01R 13/6594<br>439/607.01 |
| 2017/0194748 | A1 * | 7/2017 | Peng | H01R 13/6585 |
| 2017/0214193 | A1 * | 7/2017 | Tsai | H01R 13/658 |
| 2017/0222353 | A1 * | 8/2017 | Zhang | H01R 13/6581 |

FOREIGN PATENT DOCUMENTS

| | | | |
|---|---|---|---|
| JP | 2017-37851 | A | 2/2017 |
| JP | 2017-517118 | A | 6/2017 |
| JP | 2017-520091 | A | 7/2017 |
| JP | 2017-220369 | A | 12/2017 |
| TW | M559518 | U | 5/2018 |
| TW | 201906241 | A | 2/2019 |

* cited by examiner

CONNECTOR HAVING SPACER ENHANCING CONNECTIONS WITH CONTACTS AND MANUFACTURING METHOD THEREOF

CROSS-REFERENCE TO RELATED APPLICATION

This non-provisional application claims priority under 35 U.S.C. § 119(a) to Patent Application No. 201911250694.3 filed in China, P.R.C. on Dec. 9, 2019, the entire contents of which are hereby incorporated by reference.

BACKGROUND

Technical Field

The instant disclosure relates to a connector and a manufacturing method thereof.

Related Art

According to a connector assembly known to the inventor(s), insert molding needs to be performed on upper contacts and bottom contacts to form respective clappers. Then the clappers are assembled with an electromagnetic compatibility (EMC) pad and a middle plate. Finally, over molding is performed. The process involves many complicated steps, and requires a relatively large quantity of molds. Many workers are required to assemble a semi-finished product.

Therefore, how to reduce the use of the molds while ensuring requirements of assembly convenience to reduce manpower and how to reduce the cost of a manufacturing method known to the inventor(s) are problems to be solved by researchers.

SUMMARY

In view of this, an embodiment of the instant disclosure provides a connector. The connector includes a plurality of first contacts, a plurality of second contacts, a middle plate, a first EMC pad, a second EMC pad, an insulating body, and a spacer. The second contacts are located below the first contacts. The middle plate is clamped between the first contacts and the second contacts. The first EMC pad is located above the first contacts, and connected to an upper surface of the middle plate. The second EMC pad is located below the second contacts, and connected to a lower surface of the middle plate. The insulating body is partially embedded with the first contacts, the second contacts, the middle plate, the first EMC pad, and the second EMC pad. The spacer is formed between the first contacts and the second contacts, and partially embedded with the first contacts and the second contacts.

In some embodiments, the first EMC pad and the second EMC pad are connected to the middle plate by means of spot welding respectively, thereby achieving a better grounding effect.

In some embodiments, each of the first contacts and the second contacts includes a contact portion, a connecting portion, and a welding portion. The connecting portion is connected between the contact portion and the welding portion, the contact portion is exposed from the spacer, the connecting portion is located in the insulating body, and the welding portion is extending out of the insulating body.

In some embodiments, the insulating body further includes a plurality of notches. The notches are respectively disposed between the contact portions of any two adjacent first contacts of the first contacts, and between the contact portions of any two adjacent second contacts of the second contacts.

In some embodiments, the first EMC pad includes a first connecting portion and a second connecting portion, where the first connecting portion and the second connecting portion are partially exposed from the insulating body; and the second EMC pad includes a third connecting portion and a fourth connecting portion, where the third connecting portion and the fourth connecting portion are partially exposed from the insulating body.

In some embodiments, the first EMC pad includes a fifth connecting portion, where the first connecting portion is parallel to the second connecting portion, the fifth connecting portion is connected between the first connecting portion and the second connecting portion, and the fifth connecting portion is perpendicular to the first connecting portion and the second connecting portion respectively; the second EMC pad includes a sixth connecting portion, where the third connecting portion is parallel to the fourth connecting portion, the sixth connecting portion is connected between the third connecting portion and the fourth connecting portion, and the sixth connecting portion is perpendicular to the third connecting portion and the fourth connecting portion respectively.

In some embodiments, the first EMC pad is located above the connecting portions of the first contacts, and the second EMC pad is located below the connecting portions of the second contacts.

In some embodiments, a shell sheathed on the insulating body is further included, where an inner side of the shell is in contact with the second connecting portion of the first EMC pad and the fourth connecting portion of the second EMC pad respectively.

In some embodiments, an outer shell is disposed on the shell.

According to another embodiment of the instant disclosure, a manufacturing method of a connector is provided. The method includes: providing a middle plate to be clamped between a plurality of first contacts and a plurality of second contacts; providing a first EMC pad and a second EMC pad to be respectively connected to the middle plate to form a semi-finished product; forming an insulating body by means of insert molding so that the insulating body is partially embedded with the first contacts, the second contacts, the middle plate, the first EMC pad, and the second EMC pad; and forming a spacer by means of over molding so that the spacer is formed between the first contacts and the second contacts and is partially embedded with the first contacts and the second contacts.

In some embodiments, before the insert molding, the manufacturing method further includes: disposing a plurality of formed components to space apart contact portions of any two adjacent first contacts of the first contacts, and space apart contact portions of any two adjacent second contacts of the second contacts, to form a plurality of notches.

In some embodiments, the manufacturing method further includes: providing a shell to be sheathed on the insulating body, where an inner side of the shell is in contact with a second connecting portion of the first EMC pad and a fourth connecting portion of the second EMC pad.

In some embodiments, the manufacturing method further includes: providing an outer shell to be disposed on the shell.

In this way, in a process of manufacturing a connector, the mold cost for one insert molding process and the manufacturing cost can be reduced based on the improvement on the connector structure and the manufacturing method thereof. In addition, in an assembly operation process of the semi-finished product, steps can be reduced to reduce required manpower, to effectively reduce the production cost.

The detailed features and advantages of the instant disclosure are described in detail in the embodiments below, and contents are sufficient to enable any person skilled in the art to understand and implement the technical contents of the instant disclosure. In addition, any person skilled in the art can understand objectives and advantages of the instant disclosure easily according to the contents disclosed in this specification, claims, and accompanying drawings.

DETAILED DESCRIPTION

Figure 1:
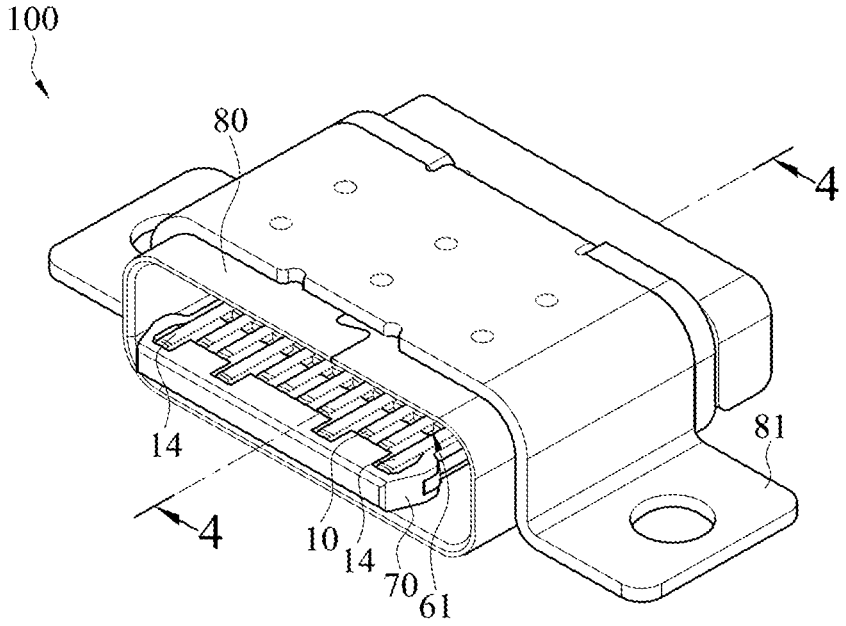
FIG. 1 is a schematic view of an appearance of a connector according to a first embodiment of the instant disclosure.
Figure 2:
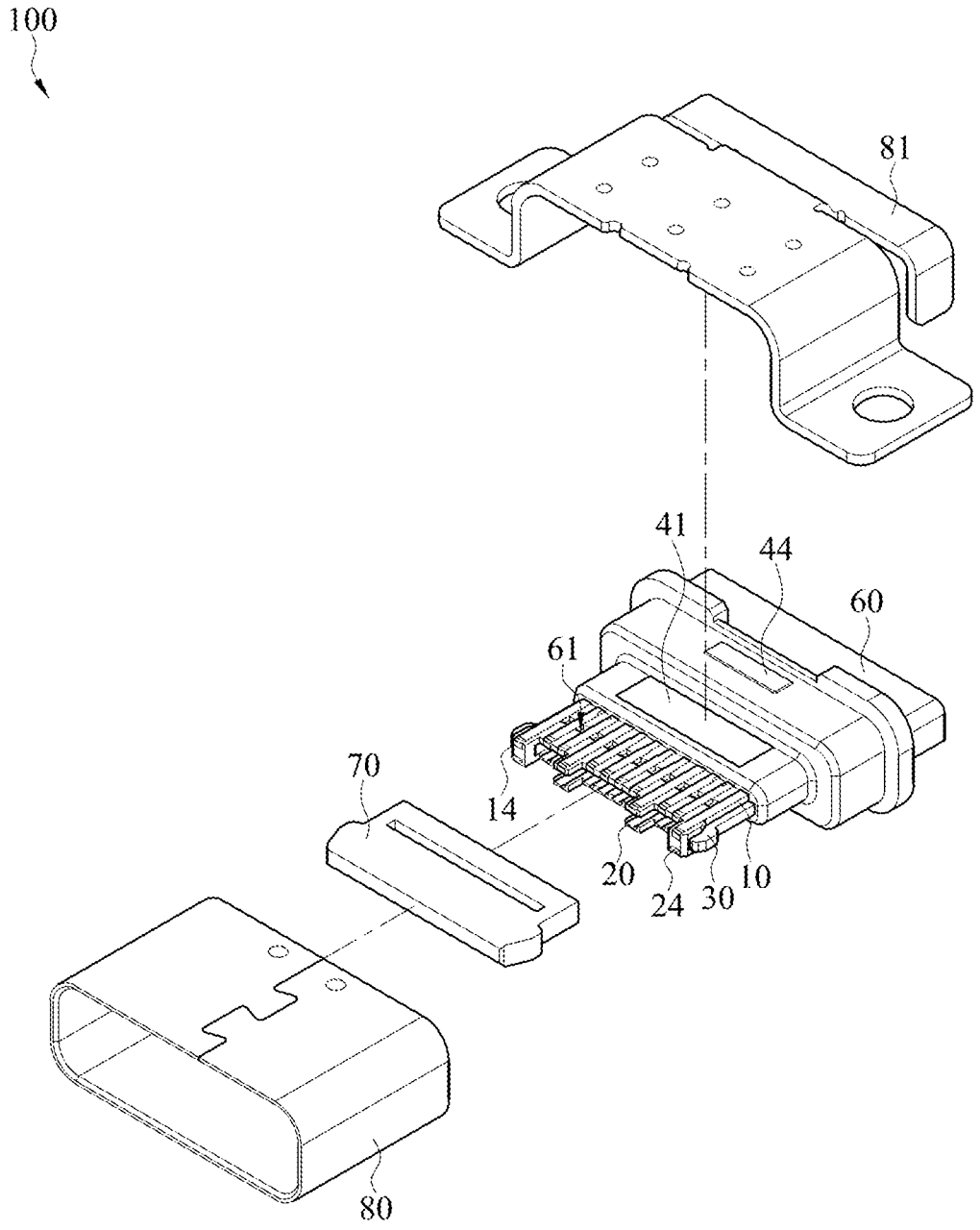
FIG. 2 is an exploded view of the connector according to a first embodiment of the instant disclosure.

FIG. 1 and FIG. 2 show a first embodiment of a connector 100 of the instant disclosure. FIG. 1 is a schematic diagram of an appearance, and FIG. 2 is an exploded view. In this embodiment, the connector 100 includes a plurality of first contacts 10, a plurality of second contacts 20, a middle plate 30, a first EMC pad 40, a second EMC pad 50, an insulating body 60, and a spacer 70.

Referring to FIG. 1, in this embodiment, the connector 100 complies with USB (Type C) connection interface specifications, but embodiments are not limited thereto. In some embodiments, the connector 100 may comply with HDMI connection interface specifications. A USB (Type C) connector 100 is described herein.

Figure 3:
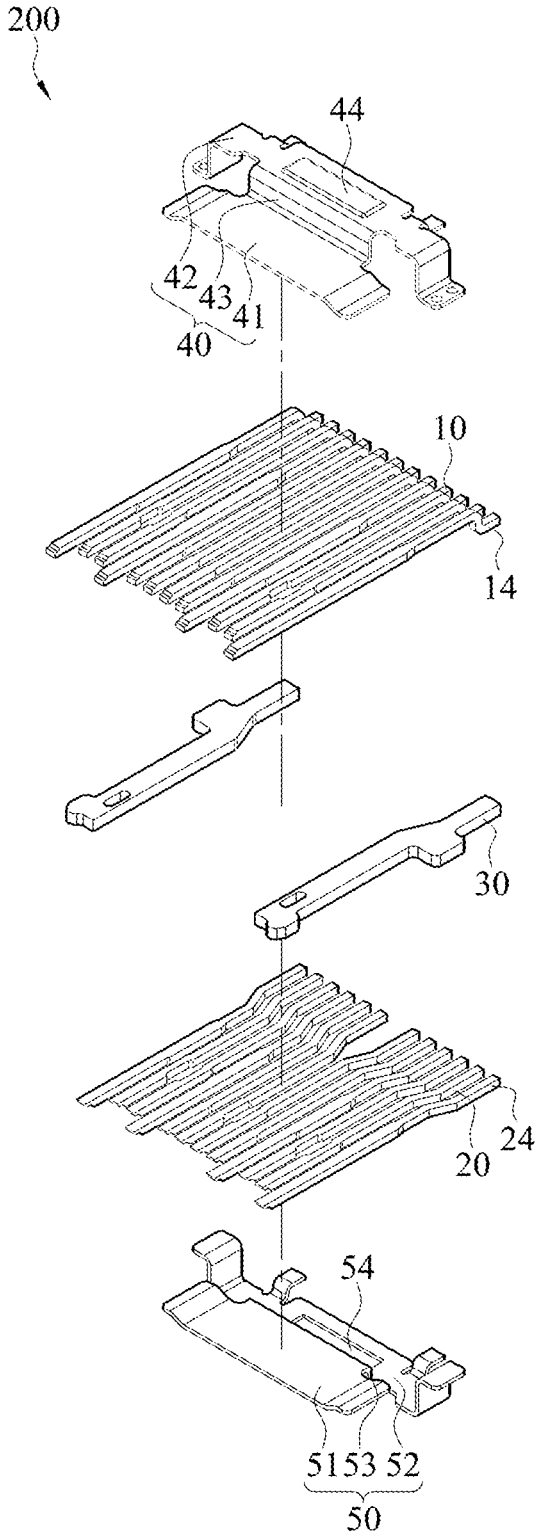
FIG. 3 is an exploded view of a semi-finished product of the connector according to a first embodiment of the instant disclosure.

Referring to FIG. 3, in this embodiment, the middle plates 30 are two split components, and the two middle plates 30 are clamped between two outermost contacts 14 of the first contacts 14 and two outermost contacts 24 of the second contacts 20 respectively.

Referring to FIG. 3, in this embodiment, the first EMC pad 40 is located above the first contacts 10, and is connected to upper surfaces of the two middle plates 30. The second EMC pad 50 is located below the second contacts 20, and is connected to lower surfaces of the two middle plates 30.

Referring to FIG. 2, in this embodiment, the insulating body 60 is partially embedded with the first contacts 10, the second contacts 20, the two middle plates 30, the first EMC pad 40, and the second EMC pad 50. The spacer 70 is formed between the first contacts 10 and the second contacts 20, and is partially embedded with the first contacts 10 and the second contacts 20.

The steps of the process can be reduced based on an improvement on the connector structure, so that the required assembly manpower can be reduced to effectively reduce the production cost.

FIG. 3 is a schematic exploded view of a semi-finished product of a connector according to a first embodiment of the instant disclosure. In this embodiment, the first EMC pad 40 and the second EMC pad 50 are connected to the two middle plates 30 by means of spot welding in a vertical direction to form a semi-finished product 200, but embodiments are not limited thereto. In some embodiments, the semi-finished product 200 may further be formed by means of conductive coating, hot melting, ultrasound melting, or other connection methods, and all these methods can reduce steps to facilitate subsequent processes.

Referring to FIG. 3, in this embodiment, the first EMC pad 40 and the second EMC pad 50 are connected to the two middle plates 30 respectively by means of spot welding, which is firmer and has a better grounding effect than the direct contact.

Referring to FIG. 3, in this embodiment, the second contacts 20 are arranged in parallel longitudinally, and are located below the first contacts 10. The first contacts 10 are also arranged in parallel longitudinally as described above.

Referring to FIG. 3, in this embodiment, the first contacts 10 are all linear. The second contacts 20 are bent at the rear ends and arranged symmetrically, being narrow at the front and wide at the rear, but embodiments are not limited thereto. In some embodiments, shapes of the first contacts 10 and the second contacts 20 can be adjusted according to use functions.

Referring to FIG. 3, in this embodiment, the two middle plates 30 are two straight-strip-shaped split components respectively, but embodiments are not limited thereto. In some embodiments, the middle plate 30 may shape like a single plate, and two sides of the single plate-like middle plate 30 may be clamped between two outermost contacts 14 of the first contacts 10 and the two outermost contacts 24 of the second contacts 20 respectively. Regardless of being a plurality of split components or a single component, the middle plate 30 is intended to achieve a grounding effect.

Figure 4:
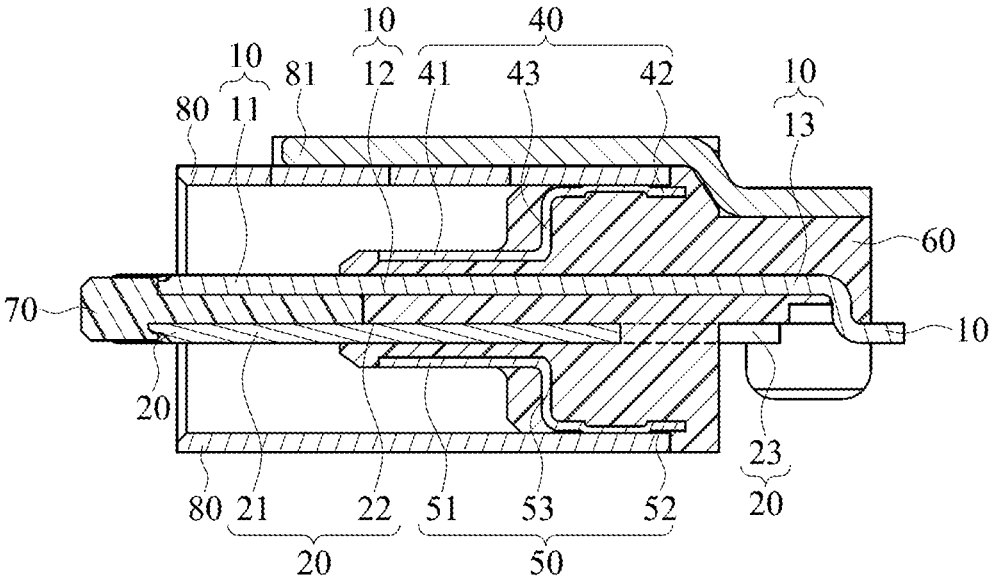
FIG. 4 is a cross-sectional view of the connector according to a first embodiment of the instant disclosure.

FIG. 4 is a schematic cross-sectional view of a connector according to a first embodiment of the instant disclosure. In this embodiment, the first contacts 10 and the second contacts 20 each include a contact portion 11, 21, a connecting portion 12, 22, and a welding portion 13, 23. The connecting portion 12, 22 is connected between the contact portion 11, 21 and the welding portion 13, 23. The contact portion 11, 21 is exposed from the spacer 70. The connecting portion 12, 22 is located in the insulating body 60. The welding portion 13, 23 is extending out of the insulating body 60.

Referring to FIG. 4, in this embodiment, the first EMC pad 40 includes a first connecting portion 41 and a second connecting portion 42. The first connecting portion 41 and the second connecting portion 42 are partially exposed from the insulating body 60. The second EMC pad 50 includes a third connecting portion 51 and a fourth connecting portion 52. The third connecting portion 51 and the fourth connecting portion 52 are partially exposed from the insulating body 60. When the connector 100 is docked, the first connecting portion 41 and the third connecting portion 51 come into contact with the elastic piece of the plug.

Referring to FIG. 4, in this embodiment, the first EMC pad 40 includes a fifth connecting portion 43. The first connecting portion 41 is parallel to the second connecting portion 42, the fifth connecting portion 43 is connected between the first connecting portion 41 and the second connecting portion 42, and the fifth connecting portion 43 is perpendicular to the first connecting portion 41 and the second connecting portion 42 respectively. The second EMC pad 50 includes a sixth connecting portion 53. The third connecting portion 51 is parallel to the fourth connecting portion 52, the sixth connecting portion 53 is connected between the third connecting portion 51 and the fourth connecting portion 52, and the sixth connecting portion 53 is perpendicular to the third connecting portion 51 and the fourth connecting portion 52 respectively.

A conventional EMC pad is an annular element, sheathed on two clappers and a middle plate to form a semi-finished product. Referring to FIG. 4, in this embodiment, the structure of the EMC pad is different from that of the conventional one, and the EMC pad is a split-type component composed of two elements, that is, the first EMC pad 40 and the second EMC pad 50, which are connected to the two middle plates 30 by means of spot welding.

Referring to FIG. 4, in this embodiment, the first EMC pad 40 is located above the connecting portions 12 of the first contacts 10, and the second EMC pad 50 is located below the connecting portions 22 of the second contacts 20.

Referring to FIG. 1 and FIG. 4, in this embodiment, the connector 100 further includes a shell 80 sheathed on the insulating body 60, where an inner side of the shell 80 is in contact with the second connecting portion 42 of the first EMC pad 40 and the fourth connecting portion 52 of the second EMC pad 50. In this embodiment, the connector 100 further includes an outer shell 81 disposed on the shell 80.

Figure 5:
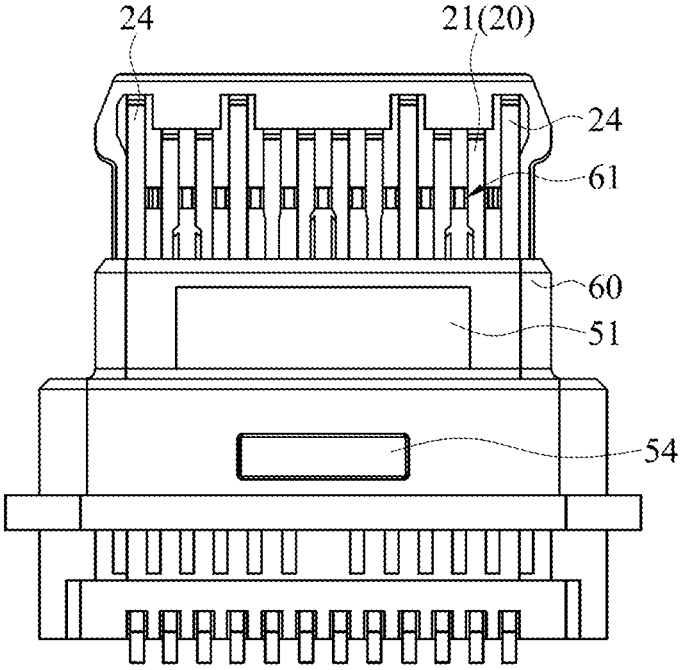
FIG. 5 is a bottom view of the connector according to a first embodiment of the instant disclosure.
Figure 5A:
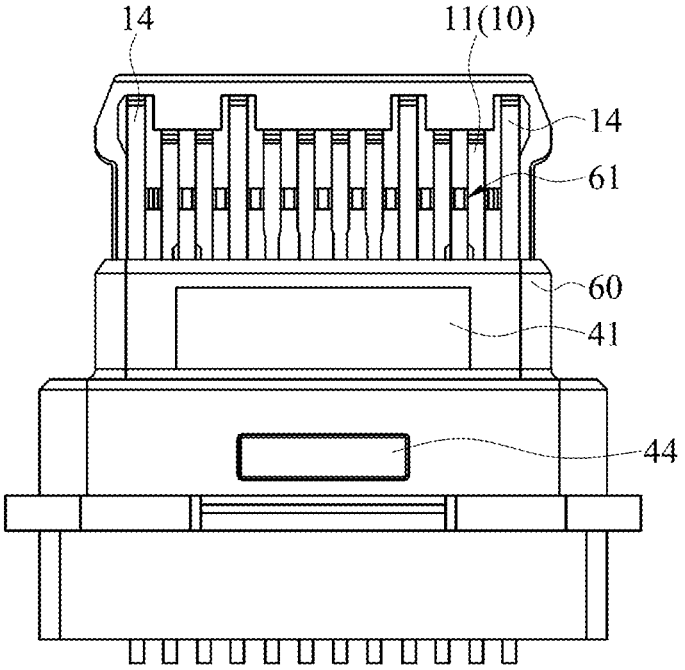
FIG. 5A is a top view of the connector according to a first embodiment of the instant disclosure.

Referring to FIG. 2, FIG. 5, and FIG. 5A, FIG. 5 is a schematic bottom view of a connector according to a first embodiment, and FIG. 5A is a schematic top view of a connector according to a first embodiment. As shown in FIG. 5 and FIG. 5A, the shell 80 and the outer shell 81 are omitted in the figure. In this embodiment, the insulating body 60 further includes a plurality of notches 61. The notches 61 are respectively disposed between the contact portions 11 of any two adjacent first contacts 10 of the first contacts 10, and between the contact portions 21 of any two adjacent second contacts 20 of the second contacts 20.

Figure 6:
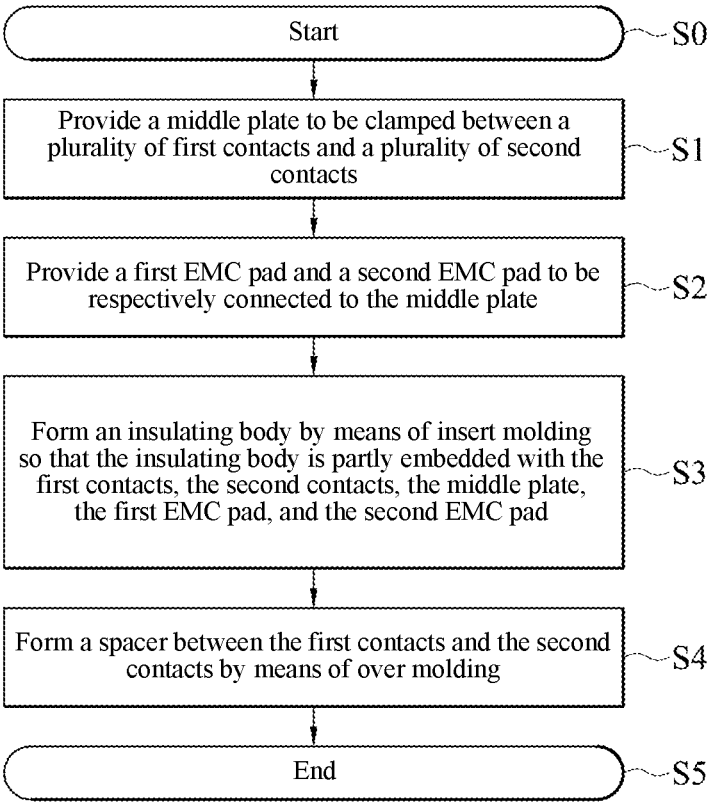
FIG. 6 is a flowchart of a manufacturing method of a connector according to a second embodiment of the instant disclosure.

FIG. 6 is a flowchart of a manufacturing method of a connector according to a second embodiment of the instant disclosure. The method includes: starting (step S0); providing a middle plate to be clamped between a plurality of first contacts and a plurality of second contacts (step S1); providing a first EMC pad and a second EMC pad to be respectively connected to the middle plate (step S2), so that a semi-finished product 200 can be formed first, where the semi-finished product 200 includes a plurality of first contacts 10, a plurality of second contacts 20, a middle plate 30, a first EMC pad 40, and a second EMC pad 50; forming an insulating body by means of insert molding, so that the insulating body is partially embedded with the first contacts, the second contacts, the middle plate, the first EMC pad, and the second EMC pad (step S3); and forming a spacer between the first contacts and the second contacts by means of over molding (step S4); and ending (step S5).

The mold cost for one insert molding process and the manufacturing cost can be reduced by using the manufacturing method of assembling the semi-finished product 200 first, thereby effectively reducing the production cost.

In this embodiment, the first EMC pad 40 and the second EMC pad 50 are connected to the two middle plates 30 by means of spot welding respectively, but embodiments are not limited thereto. In some embodiments, the semi-finished product 200 may further be formed by means of conductive coating, hot melting, ultrasound melting, or other connection methods, and all these methods can reduce steps to facilitate subsequent processes.

In some embodiments, the first contacts 10 and the second contacts 20 each include a contact portion 11, 21, a connecting portion 12, 22, and a welding portion 13, 23. The connecting portion 12, 22 is connected between the contact portion 11, 21 and the welding portion 13, 23. The contact portion 11, 21 is exposed from the spacer 70. The connecting portion 12, 22 is located in the insulating body 60. The welding portion 13, 23 is extending out of the insulating body 60.

Figure 7:
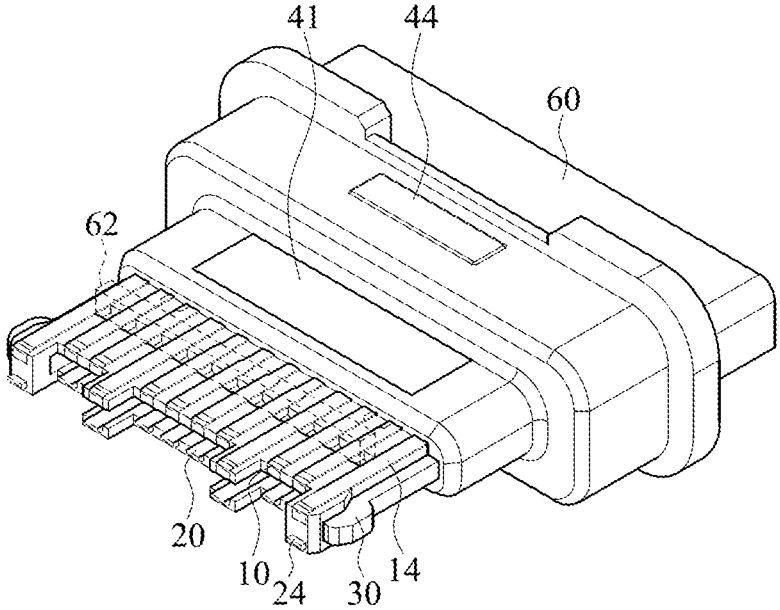
FIG. 7 is a schematic diagram of spacing with formed components of the connector according to a second embodiment of the instant disclosure.

FIG. 7 is a schematic diagram of spacing with formed components of a connector according to a second embodiment. In this embodiment, before the insert molding of step S3, a plurality of formed components 62 can be disposed in the mold to space the contact portions 11 of any two adjacent first contacts 10 of the first contacts 10 apart, and space the contact portions 21 of any two adjacent second contacts 20 of the second contacts 20 apart, to prevent the contacts from being in contact laterally. Moreover, a plurality of notches 61 is formed on the insulating body 60. The formed components 62 are punches in a mold hole, and will exit with the mold during de-molding.

Figure 8:
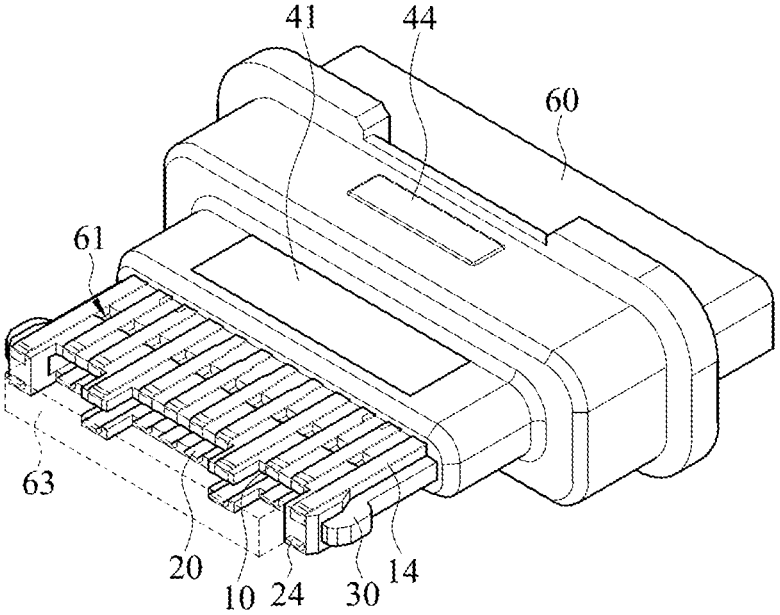
FIG. 8 is a schematic diagram of spacing with formed pieces of the connector according to a second embodiment of the instant disclosure.

FIG. 8 is a schematic diagram of spacing with a formed piece of a connector according to a second embodiment. In this embodiment, before the insert molding of step S3, a formed piece 63 is disposed in advance to space the first contacts 10 and the second contacts 20 apart, to prevent vertical contact between contacts and provide support. The formed piece 63 is a formed fixture, before the over molding of step S4, the formed piece 63 is taken out first, and then the over molding is performed.

In this embodiment, during the insert molding of step S3, the welding portions 13 of the first contacts 10 and the welding portions 23 of the second contacts 20 are supported by a material strip connection, to be removed after the insert molding. In some embodiments, in step S3, the first contacts 10 and the second contacts 20 are not over-molded with other insulating plastic bodies.

Figure 9:
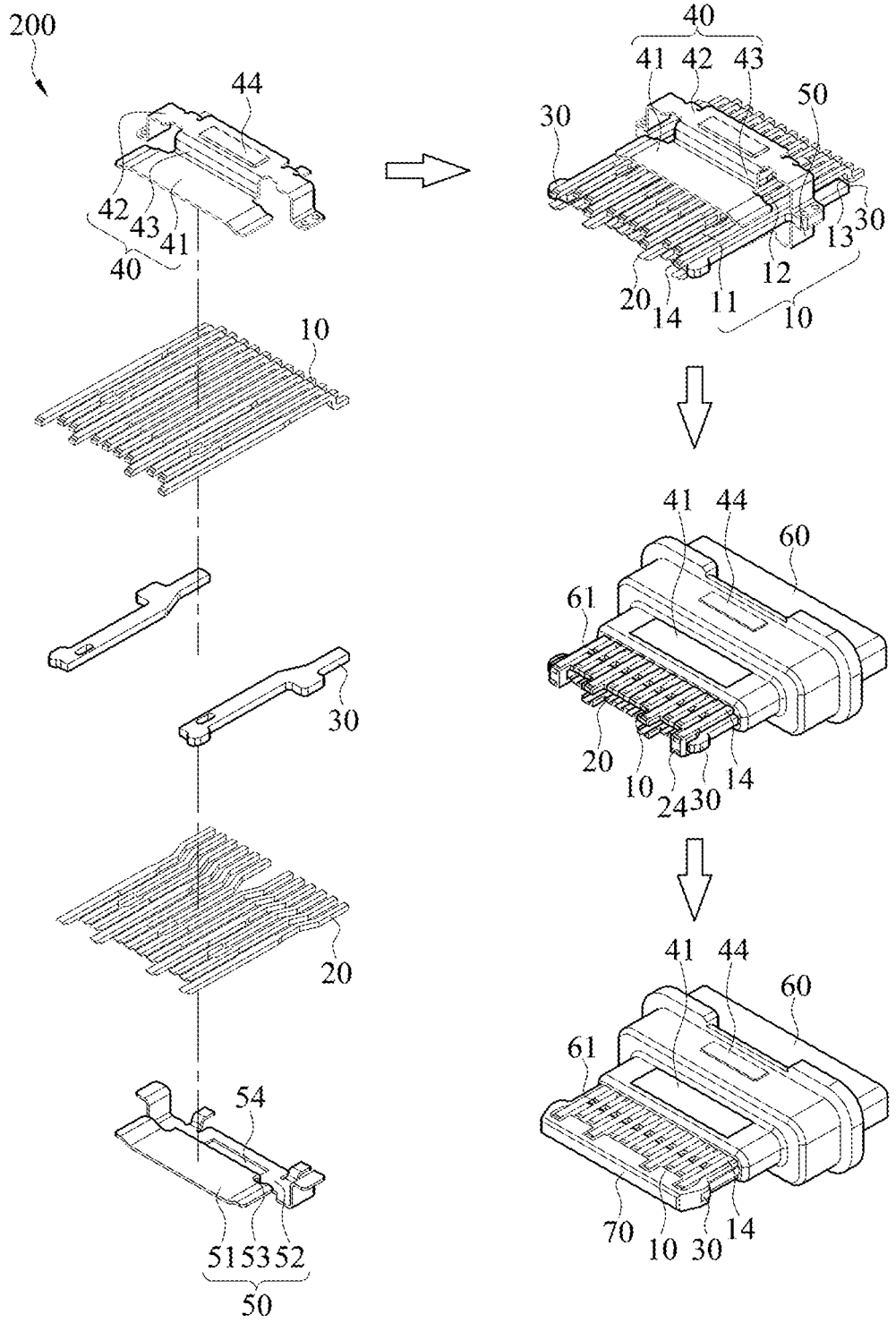
FIG. 9 is a schematic diagram a manufacturing method of the connector according to a second embodiment of the instant disclosure.

FIG. 9 is a schematic diagram of a manufacturing method of a connector according to a second embodiment of the instant disclosure. In this embodiment, the first EMC pad 40 includes a first connecting portion 41 and a second connecting portion 42, where the first connecting portion 41 and the second connecting portion 42 are partially exposed from the insulating body 60. The second EMC pad 50 includes a third connecting portion 51 and a fourth connecting portion 52, where the third connecting portion 51 and the fourth connecting portion 52 are partially exposed from the insulating body 60. When the connector is docked, the first connecting portion 41 and the third connecting portion 51 will come into contact with the elastic piece of the plug.

Referring to FIG. 9, in this embodiment, the first EMC pad 40 includes a fifth connecting portion 43, where the first connecting portion 41 is parallel to the second connecting portion 42, the fifth connecting portion 43 is connected between the first connecting portion 41 and the second connecting portion 42, and the fifth connecting portion 43 is perpendicular to the first connecting portion 41 and the second connecting portion 42 respectively. The second EMC pad 50 includes a sixth connecting portion 53, where the third connecting portion 51 is parallel to the fourth connecting portion 52, the sixth connecting portion 53 is connected between the third connecting portion 51 and the fourth connecting portion 52, and the sixth connecting portion 53 is perpendicular to the third connecting portion 51 and the fourth connecting portion 52 respectively.

Referring to FIG. 9, in this embodiment, the first EMC pad 40 is located above the connecting portions 12 of the first contacts 10, and the second EMC pad 50 is located below the connecting portions 22 of the second contacts 20.

Referring to FIG. 9, in this embodiment, the second connecting portion 42 of the first EMC pad 40 and the fourth connecting portion 52 of the second EMC pad 50 are each provided with a rectangular bump 44, 54. In this case, after the insert molding, the rectangular bumps 44, 54 will be exposed from the insulating body 60.

Referring to FIG. 9, in this embodiment, the first connecting portion 41 and the second connecting portion 42 of the first EMC pad 40, and the third connecting portion 51 and the fourth connecting portion 52 of the second EMC pad 50 are exposed from the insulating body 60 after the insert molding. Steps of assembling another EMC pad after the insert molding in the conventional process can be omitted to reduce a process time and manpower, and the part embedded in the insulating body 60 is fixed with the two middle plates 30 by means of spot welding, which has a better grounding effect.

In this embodiment, a shell 80 is further provided to be sheathed on the insulating body 60, and an inner side of the shell 80 is in contact with the second connecting portion 42 of the first EMC pad 40 and the fourth connecting portion 52 of the second EMC pad 50.

To sum up, in a manufacturing process of the connector 100 according to the instant disclosure, the mold cost for one insert molding process and the manufacturing cost can be reduced. In addition, in an assembly operation process of the semi-finished product, steps are reduced to reduce required manpower, thereby effectively reducing the production cost.

What is claimed is:

1. A connector, comprising:

a plurality of first contacts;

a plurality of second contacts, located below the first contacts;

a middle plate, clamped between the first contacts and the second contacts;

a first electromagnetic compatibility (EMC) pad, located above the first contacts, wherein the first EMC pad is connected to the middle plate;

a second EMC pad, located below the second contacts, wherein the second EMC pad is connected to the middle plate;

an insulating body, partially embedded with the first contacts, the second contacts, the middle plate, the first EMC pad, and the second EMC pad; and an over-molded spacer, the over-molded spacer over-molded and formed between the first contacts and the second contacts, and partially embedded with the first contacts and the second contacts;

wherein, the first contacts and the second contacts each comprise a contact portion, a connecting portion, and a welding portion, the connecting portion is connected between the contact portion and the welding portion, the contact portion is exposed from the over-molded spacer, the connecting portion is located in the insulating body, the welding portion is extending out of the insulating body, and the over-molded spacer contacts the inner surfaces of the contact portion of the first contacts and the second contacts.

2. The connector according to claim 1, wherein the first EMC pad and the second EMC pad are separately connected to the middle plate by means of spot welding.

3. The connector according to claim 1, wherein the insulating body further comprises a plurality of notches, the notches are respectively spaced between the contact portions of any two adjacent first contacts of the first contacts, and between the contact portions of any two adjacent second contacts of the plurality of second contacts.

4. The connector according to claim 1, wherein the first EMC pad is located above the connecting portions of the first contacts, and the second EMC pad is located below the connecting portions of the second contacts.

5. The connector according to claim 1, wherein the first EMC pad comprises a first connecting portion and a second connecting portion, the first connecting portion and the second connecting portion being partially exposed from the insulating body; and the second EMC pad comprises a third connecting portion and a fourth connecting portion, the third connecting portion and the fourth connecting portion being partially exposed from the insulating body.

6. The connector according to claim 5, wherein the first EMC pad comprises a fifth connecting portion, the first connecting portion is parallel to the second connecting portion, the fifth connecting portion is connected between the first connecting portion and the second connecting portion, and the fifth connecting portion is perpendicular to the first connecting portion and the second connecting portion respectively; the second EMC pad comprises a sixth connecting portion, the third connecting portion is parallel to the fourth connecting portion, the sixth connecting portion is connected between the third connecting portion and the fourth connecting portion, and the sixth connecting portion is perpendicular to the third connecting portion and the fourth connecting portion respectively.

7. The connector according to claim 5, further comprising a shell sheathed on the insulating body, wherein an inner side of the shell is in contact with the second connecting portion of the first EMC pad and the fourth connecting portion of the second EMC pad.

8. The connector according to claim 7, further comprising an outer shell disposed on the shell.

9. A manufacturing method of a connector, comprising:

providing a middle plate to be clamped between a plurality of first contacts and a plurality of second contacts, wherein the first contacts and the second contacts each comprise a contact portion, a connecting portion, and a welding portion, and the connecting portion is connected between the contact portion and the welding portion;

providing a first electromagnetic compatibility (EMC) pad and a second EMC pad to be respectively connected to the middle plate;

forming an insulating body by means of insert molding so that the insulating body is partially embedded with the first contacts, the second contacts, the two middle plates, the first EMC pad, and the second EMC pad, wherein the connecting portions of the first contacts and the second contacts are located in the insulating body; and forming an over-molded spacer by means of over molding so that the over-molded spacer is formed between the first contacts and the second contacts and is partially embedded with the first contacts and the second contacts, wherein the contact portion is exposed from the over-molded spacer, the welding portion is extending out of the insulating body, and the over-molded spacer contacts the inner surfaces of the contact portion of the first contacts and the second contacts.

10. The manufacturing method according to claim 9, wherein the first EMC pad and the second EMC pad are separately connected to the middle plate by means of spot welding.

11. The manufacturing method according to claim 9, wherein the first EMC pad is located above the connecting portions of the first contacts, and the second EMC pad is located below the connecting portions of the second contacts.

12. The manufacturing method according to claim 9, wherein before the insert molding, the manufacturing method further comprises: disposing a plurality of formed components to space the contact portions of any two adjacent first contacts of the first contacts apart, and space the contact portions of any two adjacent second contacts of the second contacts apart, to form a plurality of notches.

13. The manufacturing method according to claim 9, wherein the first EMC pad comprises a first connecting portion and a second connecting portion, the first connecting portion and the second connecting portion being partially exposed from the insulating body; the second EMC pad comprises a third connecting portion and a fourth connecting portion, the third connecting portion and the fourth connecting portion being partially exposed from the insulating body.

14. The manufacturing method according to claim 13, wherein the first EMC pad comprises a fifth connecting portion, the first connecting portion is parallel to the second connecting portion, the fifth connecting portion is connected between the first connecting portion and the second connecting portion, and the fifth connecting portion is perpendicular to the first connecting portion and the second connecting portion respectively; the second EMC pad comprises a sixth connecting portion, the third connecting portion is parallel to the fourth connecting portion, the sixth connecting portion is connected between the third connecting portion and the fourth connecting portion, and the sixth connecting portion is perpendicular to the third connecting portion and the fourth connecting portion respectively.

15. The manufacturing method according to claim 13, further comprising providing a shell sheathed on the insulating body, wherein an inner side of the shell is in contact with the second connecting portion of the first EMC pad and the fourth connecting portion of the second EMC pad.

16. The manufacturing method according to claim 15, further comprising providing an outer shell disposed on the shell.

* * * * *